US006382628B2

(12) United States Patent
Stern

(10) Patent No.: US 6,382,628 B2
(45) Date of Patent: May 7, 2002

(54) CONCEPTS FOR PLAYING MULTIPLE DECK CARD GAME

(76) Inventor: Max Stern, 6351Chisos Dr., Las Vegas, NV (US) 89103

( * ) Notice: Subject to any disclaimer, the term of this patent is extended or adjusted under 35 U.S.C. 154(b) by 0 days.

(21) Appl. No.: 09/853,742

(22) Filed: May 11, 2001

Related U.S. Application Data

(60) Provisional application No. 60/203,609, filed on May 12, 2000.

(51) Int. Cl.[7] ..... A63F 1/00

(52) U.S. Cl. ..... 273/292; 463/13

(58) Field of Search ..... 273/292, 274, 273/138.1; 463/10–13

(56) References Cited

U.S. PATENT DOCUMENTS 5,042,818 A * 8/1991 Wingardt ..... 273/292
5,531,440 A * 7/1996 Dabrowski et al. ..... 463/112
5,803,809 A * 9/1998 Yoseloff ..... 463/13

* cited by examiner

*Primary Examiner*—Jessica J. Harrison
*Assistant Examiner*—Alex F. R. P. Rada, II

(57) ABSTRACT

Concepts for playing showdown card games of poker with multiple decks, with each participant having at least one individual deck in which a principal participant designates the type of poker, deals a FLOP, and establishes the COMMUNITY CARDS for each participant, based on the number of cards in a hand of the designated game. The remaining number of cards in the hand are dealt from each participant's hand, to be combined with the COMMUNITY CARDS; and participants with a winning combination are paid in accordance with a selected standard ranking of poker hands.

11 Claims, 1 Drawing Sheet

CONCEPTS FOR PLAYING MULTIPLE DECK CARD GAME

This application claims the priority of U.S. Provisional Patent Application Ser. No. 60/203,609 filed on May 12, 2000.

This invention relates to utilizing multiple decks of playing cards for playing a showdown card game while maintaining standard card symbols and values; and, maintaining poker strategies based on a participant betting on the value of his or her hand for purposes of winning a pool or pot. More specific contributions of the invention enable establishing an individual separate deck of cards for each hand played, in a single round, by each participant.

OBJECTS OF THE INVENTION

Primary objects are to provide: (a) game concepts, (b) method steps for play of a round, (c) software programming concepts for apparatus enabling multiple-decks of cards to be separately utilized in determining the value of each hand of each participant in a single round of the multiple-deck game.

A correlated object is enabling multiple individual decks of cards to be utilized in a single round of the game while maintaining an opportunity for participants to utilize poker judgment skills, derived from play of conventional showdown card games, in determining the value of a hand.

Another object is to implement machine play of multiple decks, in a single round, of a selected variety of showdown games based, at least in part, on poker modalities.

A further object is implementation of supervision and control of the flow of a multiple-deck showdown card game by a computer software program.

Another object is to provide visible winning results promptly for entertainment purposes, or, additionally, for wagering such that a casino atmosphere of chance is available for a single, or for a plurality of participants, in a single round of a multiple-deck showdown card game.

Another object is to enable a participant, or plural participants, to play more than one hand in a single round of the multiple-deck showdown card game being played.

The above and other objects, features and advantages of the present invention are described in more detail with reference to the accompanying drawings.

DETAILED DESCRIPTION OF THE INVENTION

Figure 1:
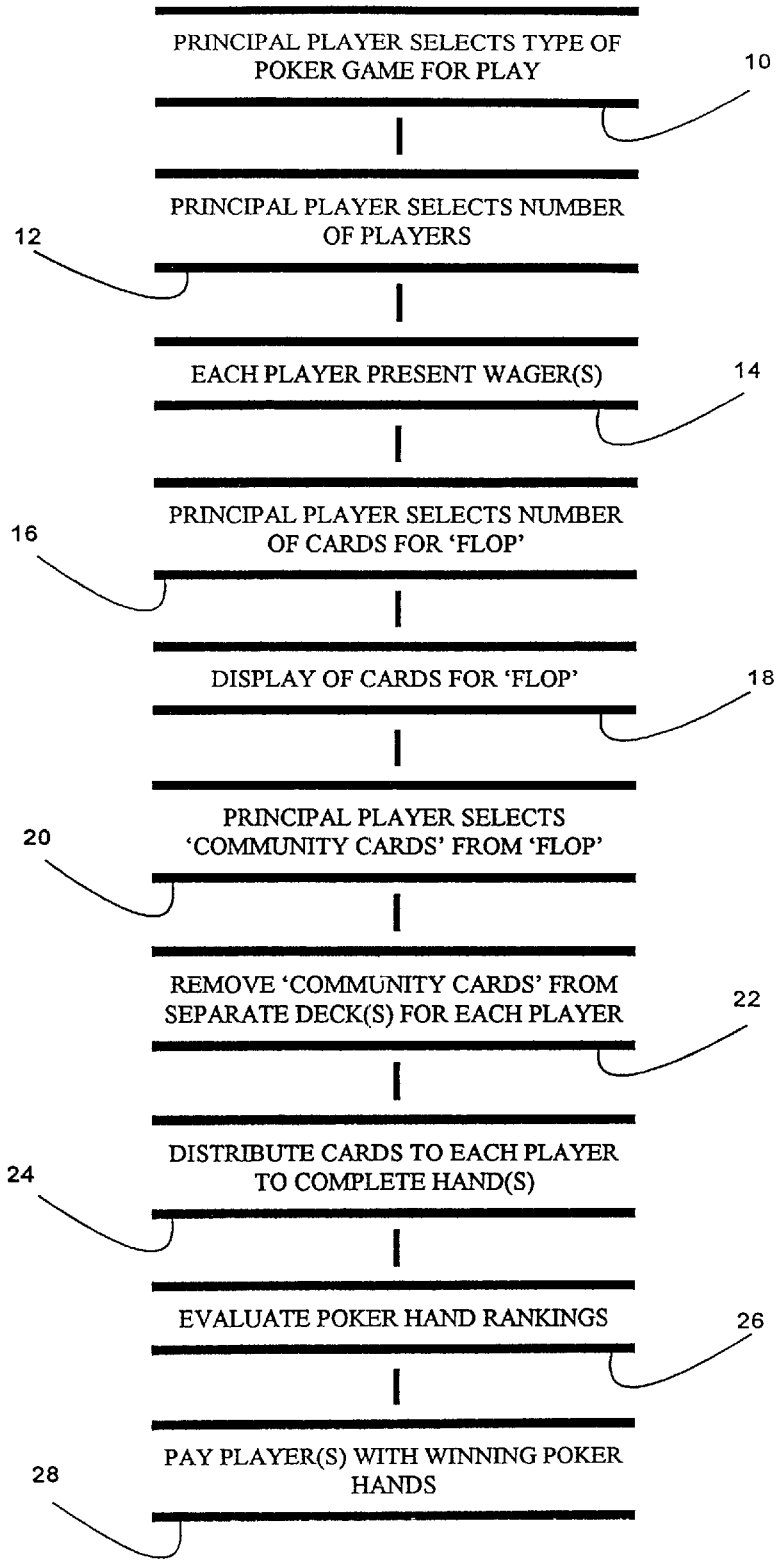
FIG. 1 is a flow chart for describing procedural steps of a specific embodiment of the invention.

In prior showdown card games, a single hand is dealt to each participant from a single deck of cards, or identical portions from two decks of cards are shuffled together, and a single hand to be analyzed is obtained from that shuffled combination.

Nevertheless, it has not been possible for a participant to play more than one hand in a single round in prior showdown games of poker. Consider that such a participant would have to physically and mentally maintain the cards of one hand separate from those of his or her other hand.

Present concepts interrelate multiple decks of cards in a single round of play while preserving some, and adding to, the possibilities ("permeations and combinations") stemming from showdown card games, such as poker.

Multiple decks of cards are individually established for such a single round by software control, which also achieves a promptly executed round of play, notwithstanding that more than one hand can be played by a single participant or that more than one participant can play plural hands in a round.

Whether solely for amusement, or for entertainment with wagering, standard designations for playing cards are utilized. The choice for "showdown" preferably is a type or variety of poker, such as stud, draw, seven-card, etc. That choice is made by a "principal participant" before the cards are dealt; and, that choice provides certain, but limited, mechanics for play of a round which are implemented by multiple-deck concepts taught herein.

In the schematic flow chart presentation (FIG. 1) for carrying out a specific embodiment of a multiple-deck showdown game, the "principal participant" chooses (at station 10) the type or variety of a showdown game of poker. For example, the "principal participant" can choose to play draw poker, seven-card stud, or five-card Omaha, etc. with or without wild cards. The chosen multiple-deck game can be played on a machine, in a casino, in a club or in a home. The "principal participant" can rotate when multiple participants take part in any of those locales. In a home game, the "principal participant" also acts as the "banker", or the "house", for play of a round. The apparatus for home or private club play, with multiple participants, enables selective determination if wagering is to be involved.

At station 12 of the specific embodiment, the "principal participant" selects the number of participants to be included in a round. A separate deck of cards is established for each participant in the game; and, if any participant desires to play more than one hand, a separate deck of cards is established for each hand to be played by that participant.

At station 14, if not earlier, each participant presents a wager, which can include an administrative fee for management of the game, as well as the "ante" to participate. Such a quantitatively fixed wager is made for each hand, if that participant selects to play more than one hand. A minimum and maximum for competitive wagering can be prescribed for an individual round. Present concepts can provide for handling differing wagering amounts for one or more participants.

At station 16, the "principal participant" designates a selected number of cards, for use by all participants, referred to as a "FLOP". A FLOP comprises designated cards from which common cards are selected and become part of each hand played by each participant in the selected round. The number of cards contained in a FLOP can depend on the game being played. For example a five-card poker FLOP may contain up to five cards. (Other FLOP selection embodiments are described later.)

Referring to the flow chart (FIG. 1), the FLOP is displayed at station 18. A predetermined number of cards are displayed (as if dealt face up) from one deck of cards. Then, the "principal participant" evaluates the cards in that FLOP based on his or her skill or knowledge in establishing common cards which are most likely to lead to the best poker hand combination available, according to the "principal participant," considering the variety of poker to be played.

At station 20, the "principal participant" selects cards from the FLOP which are to be "COMMUNITY CARDS." Such COMMUNITY CARDS are established to be used by each participant in the selected round, as part of that participant's poker hand or hands.

At station 22, identical cards corresponding to the COMMUNITY CARDS are removed from each deck of cards for each hand to be "dealt" to each participant.

At station 24, cards as needed are dealt to each participant from that participant's deck(s) of cards, from which COMMUNITY CARDS have been removed; that is, the poker hand(s) for each participant, according to the variety of game being played, are completed from such a deck or decks. For example, in a five-card poker game, if two COMMUNITY CARDS have been selected at station 20, then each participant would receive three cards from that participant's separate deck (for each hand) to complete his or her poker hand(s).

At station 26, each hand (or hands) is evaluated according to standard rank of poker hands for the combination of cards, including such COMMUNITY CARDS, dealt to each participant.

At station 28, each participant with a winning poker hand combination, is paid according to the rank for each such winning hand.

In one embodiment, the "principal participant" can choose the community cards from a single FLOP for a particular round. In a further embodiment, the game can be played using a plurality of FLOPs, in which the "principal participant" selects one FLOP from such plurality of FLOPs, which is believed to offer the greatest opportunity, with the community card, for achieving the highest ranking poker hand for the variety of poker being played. In an embodiment with a plurality of FLOPs, each FLOP is dealt from a separate deck of cards.

In a computerized embodiment of the game, each poker hand is displayed in a horizontal presentation of cards on a video screen, and is referred to as a "line". In an alternate embodiment, a participant can play a hand selected from a plurality of lines. Such selected line may be dealt without the benefit of a FLOP or COMMUNITY CARDS. Selection of such alternate line is based on such participant's skill and knowledge of the selected variety of poker to obtain a higher-ranking poker hand.

A goal of the game is to pick COMMUNITY CARDS successfully which, when combined with additional dealt cards, will provide a winning poker hand combination of cards. Participants succeed by obtaining a hand, or hands, that contains a winning combination of cards according to defined poker hand rankings, such as shown in TABLE I. If a participant's hand contains a winning poker hand combination, the participant receives payment on his or her wager. If a participant's hand does not contain a winning poker combination that participant loses his or her wager.

An additional feature, observed in the following TABLE I, is the addition of a winning combination referred to as a Mini-Royal. A Mini-Royal is defined as a poker hand comprising a sequence of cards in one suit beginning from the Ace of such suit. For example, in a five-card poker hand, a Mini-Royal would comprise the Ace, two, three, four and five of the same suit; in a three-card poker hand, a Mini-Royal would comprise the Ace, two and three of the same suit.

TABLE I

| Relative Ranking of Poker Hands and Prizes (5 card poker) | |
|---|---|
| Royal Flush (A, K, Q, J, 10 of same suit) | 800 |
| Mini Royal (A, 2, 3, 4, 5 of same suit) | 800 |

TABLE I-continued

| Relative Ranking of Poker Hands and Prizes (5 card poker) | |
|---|---|
| Four Aces (all 4 Ace cards) | 160 |
| Straight Flush (any 5 sequential cards of same suit) | 100 |
| Small Four of a Kind (any 4 cards of 2s, 3s or 4s) | 80 |
| Four of a Kind (any 4 cards of same value 5s to Ks) | 50 |
| Full House (any 3 cards of same value and 2 other cards of same value) | 10 |
| Flush (any 5 cards of same suit) | 7 |
| Straight (any 5 sequential cards of different suit) | 5 |
| Three of a Kind (any 3 cards of same value) | 3 |
| Two Pair (any 2 cards of same value and 2 other cards of same value) | 1 |
| Jacks or better (any 2 of A, K, Q, J) | 1 |

Another distinguishing concept of the game is the ability to "deal" cards to each participant from a separate deck of cards for each participant. Use of multiple decks of cards enables presentation of identical winning combinations of cards by more than one participant.

The steps and functions of a controller are established on software and take place electronically in video games to provide and distribute electronic designation of playing cards, to maintain control of play of the game for plural participants, and to sequence the steps of the game properly, while providing for selections made by a participant, or participants. Such game controller is also responsible for collecting wagers which are lost and making payments to winners, according to the applicable game of poker.

Embodiments of the game taught herein vary significantly from contemporary games of poker by dealing cards for each participant from a separate deck of cards for a single round and, enabling one or a plurality of COMMUNITY CARDS to be included in poker hands of all participants. Such multiple use of COMMUNITY CARDS is facilitated by electronic control of the game providing prompt play of the game by multiple participants.

New game concepts based on use of plural decks of cards; that is, separate decks for each participant, increase the challenge in evaluating winning combinations for each participant since, in a game played with plural participants, each participant uses the same COMMUNITY CARDS and each participant is dealt the same number of cards to complete his or her hand as necessary for the selected variety of poker being played.

The number of cards to be dealt is established when a participant at a video machine selects a type of poker game to be played and the number of cards, which is at least one less than the total number in the type of game selected, to be included in a FLOP.

Among the advantages of the invention are the simplicity of play and ease of administration. Novel concepts of this invention provide for games which are easy to administer and fun to play.

The game is preferably played in video poker machines, computers, video game machines and hand-held, mechanical or video poker devices. A video machine can enable a single player to play more than one hand at a time and can be used to accommodate a plurality of players.

The various features of novelty which characterize the invention will be pointed out with particularity in the claims of this application.

While specific values, method steps, and apparatus have been described for purposes of disclosure of new concepts so as to be understandable to those skilled in the art, it should be recognized that, in light of the above teachings, modifications can be made by those skilled in the art without departing from the patentable concepts and principles of the invention disclosed; therefore, in determining the scope of patent protection for the invention, reference shall be made to the appended claims which are to be interpreted in combination with the above disclosure.

What is claimed is:

1. Method for playing a multiple-deck card game, comprising:

(A) establishing a principal participant who:

(i) designates a version of a showdown card game in the poker family to be utilized in play of a round of the card game, (ii) establishes the number of participants for such round, and (iii) identifies the number of cards for forming a FLOP;

(B) dealing the identified number of cards for such FLOP;

(C) such principal participant selecting COMMUNITY CARDS from such FLOP to be used by each such participant with the number of such COMMUNITY CARDS which can be established based on the number of cards in a hand of the designated card;

(D) providing for at least one separate individual deck of cards for each such participant;

(E) removing such COMMUNITY CARDS from each individual deck to be used by such a participant;

(F) distributing a predetermined number of cards to each participant from remaining cards, in each such respective separate deck of cards, for each hand being played by such a participant; with (i) the same number of cards being dealt from each respective individual deck, (ii) such number of cards being established as the number necessary for combining with such COMMUNITY CARDS, to form a hand capable of being played in such selected version of a showdown game of poker; and (G) evaluating the combination of cards held by each hand of each respective participant in such round.

2. The method of claim 1, including the steps of permitting a participant to make a wager to participate when the version of poker to be played in the round has been designated, and paying such a participant a preestablished amount, based on the amount of such wager, if a hand of such participant in such round comprises a predetermined winning combination of cards.

3. The method of claim 2, in which such predetermined winning combinations are based on an accepted standard for poker hand rankings.

4. The method of claim 3, in which the principal participant:

(A) identifies a plurality of FLOPs, with (i) each FLOP containing the same number of cards, and (ii) each FLOP being dealt from a separate deck of cards; and (B) designates at least one of such plurality of FLOPs from which such COMMUNITY CARDS are selected.

5. The method of claim 3, including the steps of:

(A) establishing a plurality of lines of cards for a participant, with (i) each such line of cards being established from a separate deck of cards, (ii) permitting such plurality of lines to be established by such principal participant by selection from the group consisting of: (a) with, and (b) without the provision for a FLOP or COMMUNITY CARDS, and (iii) permitting such participant to select, from such plurality of lines of cards, a poker hand to be played.

6. A multiple-deck showdown card game played in accordance with claim 5.

7. Software-controlled apparatus, for playing a multiple-deck showdown card game of poker in accordance with claim 5.

8. Computer software for playing a showdown multiple-deck card game of poker, in accordance with claim 5, for use with apparatus selected from the group consisting of:

(i) video showdown card game machines;

(ii) personal computers;

(iii) hand held video card game devices, and (iv) hand-held video poker devices.

9. A multiple-deck showdown card game of poker played in accordance with claim 3.

10. Software-controlled apparatus, for playing a multiple-deck showdown card game of poker, in accordance with the method of claim 3.

11. Computer software for playing a multiple-deck showdown card game of poker, played in accordance with claim 3, for use with apparatus selected from the group consisting of:

(i) video card game machines;

(ii) personal computers;

(iii) hand held video card game devices, and (iv) hand-held video poker devices.

* * * * *